US011450984B2

(12) United States Patent
Chen

(10) Patent No.: US 11,450,984 B2
(45) Date of Patent: Sep. 20, 2022

(54) COAXIAL CABLE CONNECTOR

(71) Applicant: TCC RFTECH Co., Ltd., New Taipei (TW)

(72) Inventor: Yu-Kuang Chen, New Taipei (TW)

(73) Assignee: TCC RFTECH Co., Ltd., New Taipei (TW)

( * ) Notice: Subject to any disclaimer, the term of this patent is extended or adjusted under 35 U.S.C. 154(b) by 0 days.

(21) Appl. No.: 17/356,540

(22) Filed: Jun. 24, 2021

(65) Prior Publication Data

US 2022/0006228 A1 Jan. 6, 2022

(30) Foreign Application Priority Data

Jul. 6, 2020 (TW) ..... 109122779

(51) Int. Cl.
*H01R 13/52* (2006.01)
*H01R 24/40* (2011.01)
*H01R 103/00* (2006.01)

(52) U.S. Cl.
CPC ..... *H01R 13/52* (2013.01); *H01R 24/40* (2013.01); *H01R 2103/00* (2013.01)

(58) Field of Classification Search
CPC .... H01R 13/52; H01R 24/40; H01R 2103/00; H01R 9/05; H01R 9/0524; H01R 9/5202
See application file for complete search history.

(56) References Cited

U.S. PATENT DOCUMENTS

| | | | | |
|---|---|---|---|---|
| 5,667,405 | A * | 9/1997 | Holliday | H01R 13/5219 439/585 |
| 8,033,862 | B2 * | 10/2011 | Radzik | H01R 24/40 439/578 |
| 8,579,658 | B2 * | 11/2013 | Youtsey | H01R 24/40 439/578 |
| 9,419,389 | B2 * | 8/2016 | Purdy | H01R 9/0524 |
| 10,003,140 | B2 * | 6/2018 | Watkins | H01R 9/0521 |
| 2005/0118871 | A1 | 6/2005 | Zemba | |
| 2008/0085631 | A1 | 4/2008 | Holland | |
| 2018/0034213 | A1 * | 2/2018 | Lutz | H01R 9/0527 |

FOREIGN PATENT DOCUMENTS

| | | |
|---|---|---|
| TW | M505097 | 7/2015 |

* cited by examiner

*Primary Examiner* — Briggitte R. Hammond
(74) *Attorney, Agent, or Firm* — Winston Hsu

(57) ABSTRACT

A coaxial cable connector includes a metal sleeve, a metal clamping sleeve, a coupling sleeve and an elastic ring. The metal sleeve jackets an insulation layer of a coaxial cable and is coupled to a metal fence layer of the coaxial cable when the coaxial cable connector jackets the coaxial cable. The metal clamping sleeve jackets a first end portion of the metal sleeve for tightly clamping the coaxial cable. The coupling sleeve is detachably connected to a device connector and rotatably jackets a second end portion of the metal sleeve. The elastic ring is disposed in the coupling sleeve and fixedly jackets the second end portion. The elastic ring has a thick portion at least partially protruding from the second end portion relative to the metal sleeve and an abutting structure extending toward the first end portion axially for pushing the coupling sleeve against the metal clamping sleeve tightly.

6 Claims, 6 Drawing Sheets

COAXIAL CABLE CONNECTOR

BACKGROUND OF THE INVENTION

1. Field of the Invention

The present invention relates to a coaxial cable connector, and more specifically, to a coaxial cable connector having a radio frequency interference shielding function.

2. Description of the Prior Art

In the field of cable TV signal transmission, a coaxial cable is usually used as a transmission medium for signal transmission between electronic apparatuses. For convenience, the coaxial cable is connected to the electronic apparatus via a connector of the electronic apparatus for establishing a corresponding signal transmission path. In practical application, for preventing electrical connection of the coaxial cable, the connector and the electronic apparatus from being influenced by water vapor, a waterproof washer is usually disposed in the connector to avoid the short circuit problem caused by water vapor infiltration.

Please refer to FIG. 1, which is a cross-sectional diagram of a coaxial cable connector 1 according to the prior art. As shown in FIG. 1, the coaxial cable connector 1 includes an internal sleeve 3, an outer casing 5, a coupling sleeve 7, and a waterproof washer 9. After a coaxial cable 11 is disposed through the coaxial cable connector 1, an auxiliary tool is utilized to deform the outer casing 5 for clamping the coaxial cable 11 tightly, so as to make the coaxial cable 11 disposed through the coaxial cable connector 1 steadily. The waterproof washer 9 is used to prevent water vapor from infiltrating into a central conductor of the coaxial cable 11 through a gap between the coupling sleeve 7 and other connector for efficiently avoiding the short circuit problem. Furthermore, in practical application, a conductive fence layer of the coaxial cable 11 could be electrically connected to the outer casing 5 and the coupling sleeve 7 for ground connection, so as to provide a preferable shielding environment for signal transmission in the coaxial cable 11 through the coaxial cable connector 1 and maintain stability of the signal transmission. For further improving assembly convenience and providing an anti-theft function, the prior art usually adopts the design that the coupling sleeve 7 rotatably jackets the internal sleeve 3. However, in the aforesaid design, a gap may exist between the outer casing 5 and the coupling sleeve 7 to cause unstable electrical conduction between the outer casing 5 and the coupling sleeve 7, so as to influence stability of the signal transmission.

SUMMARY OF THE INVENTION

The present invention provides a coaxial cable connector detachably jacketing a coaxial cable and a device connector. The coaxial cable connector includes a metal sleeve, a metal clamping sleeve, a coupling sleeve, and an elastic ring. The metal sleeve has a sleeve body. The sleeve body jackets an insulation layer of the coaxial cable and is directly or indirectly coupled to a metal fence layer of the coaxial cable when the coaxial cable connector jackets the coaxial cable. The metal clamping sleeve jackets a first end portion of the sleeve body. The metal clamping sleeve is directly or indirectly coupled to the sleeve body and tightly clamps the coaxial cable when the metal clamping sleeve is squeezed to deform radially. The coupling sleeve has a main body and a connection section. The main body is detachably connected to the device connector. The connection section rotatably jackets a second end portion of the sleeve body. The elastic ring is disposed in the coupling sleeve and fixedly jackets the second end portion of the sleeve body. The elastic ring has a thick portion and an abutting structure. The thick portion at least partially protrudes from the second end portion in an axial direction relative to the sleeve body. The abutting structure extends toward the first end portion axially and pushes the connection section to laterally bias the coupling sleeve against the metal clamping sleeve for establishing electrical connection between the coupling sleeve and the metal clamping sleeve.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
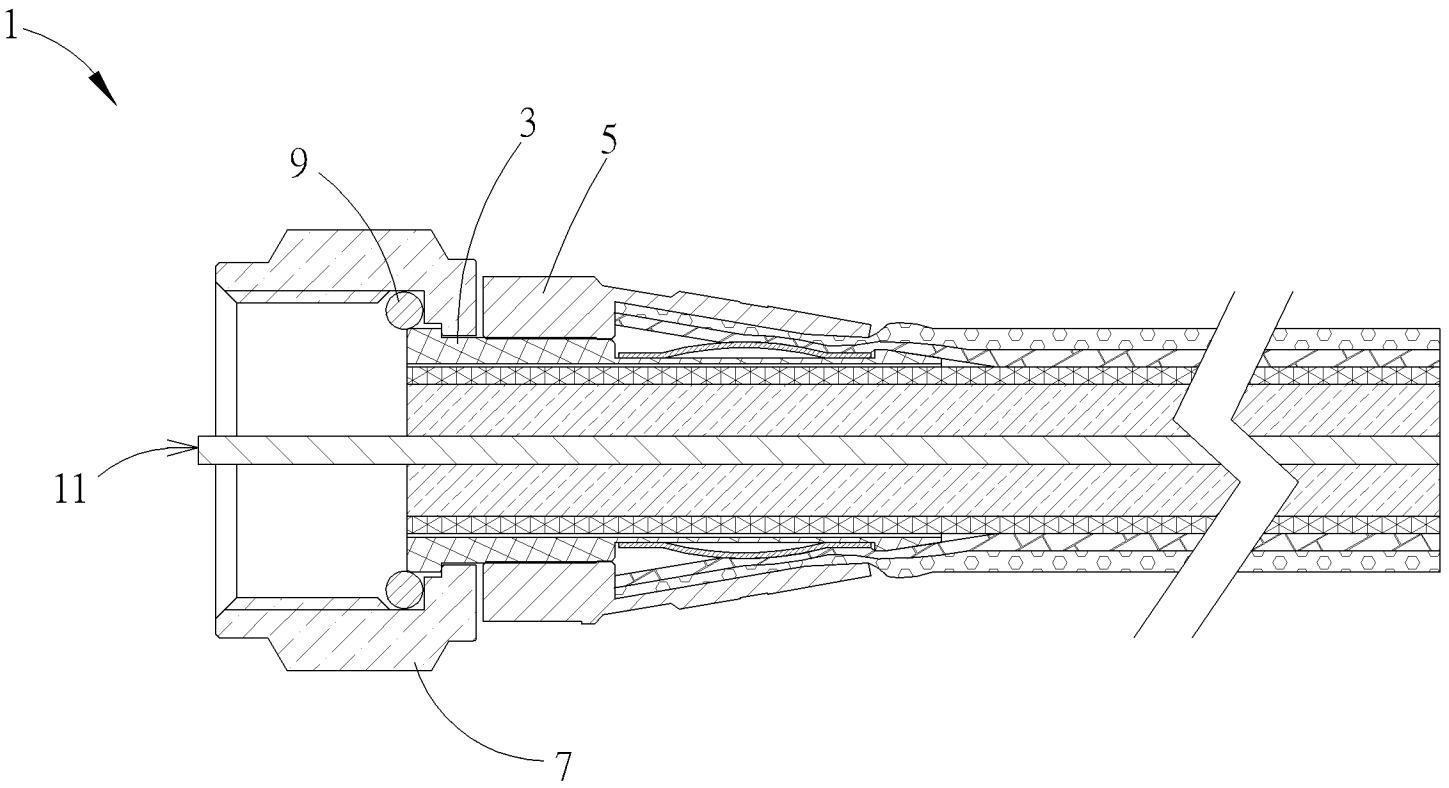
FIG. 1 PRIOR ART
FIG. 1 is a cross-sectional diagram of a coaxial cable connector according to the prior art.
Figure 2:
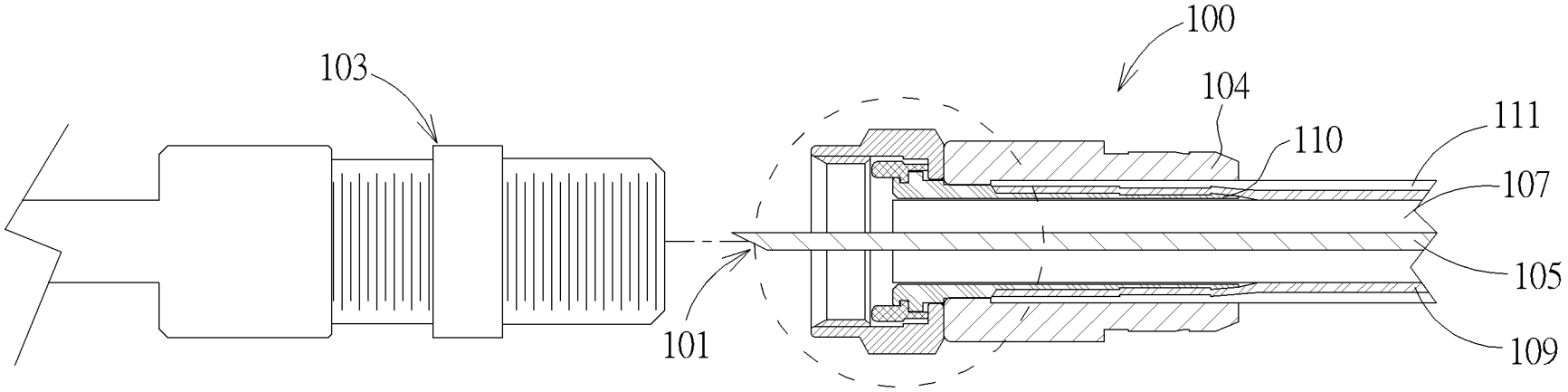
FIG. 2 is a cross-sectional diagram of a coaxial cable connector being connected to a coaxial cable according to an embodiment of the present invention.
Figure 2A:
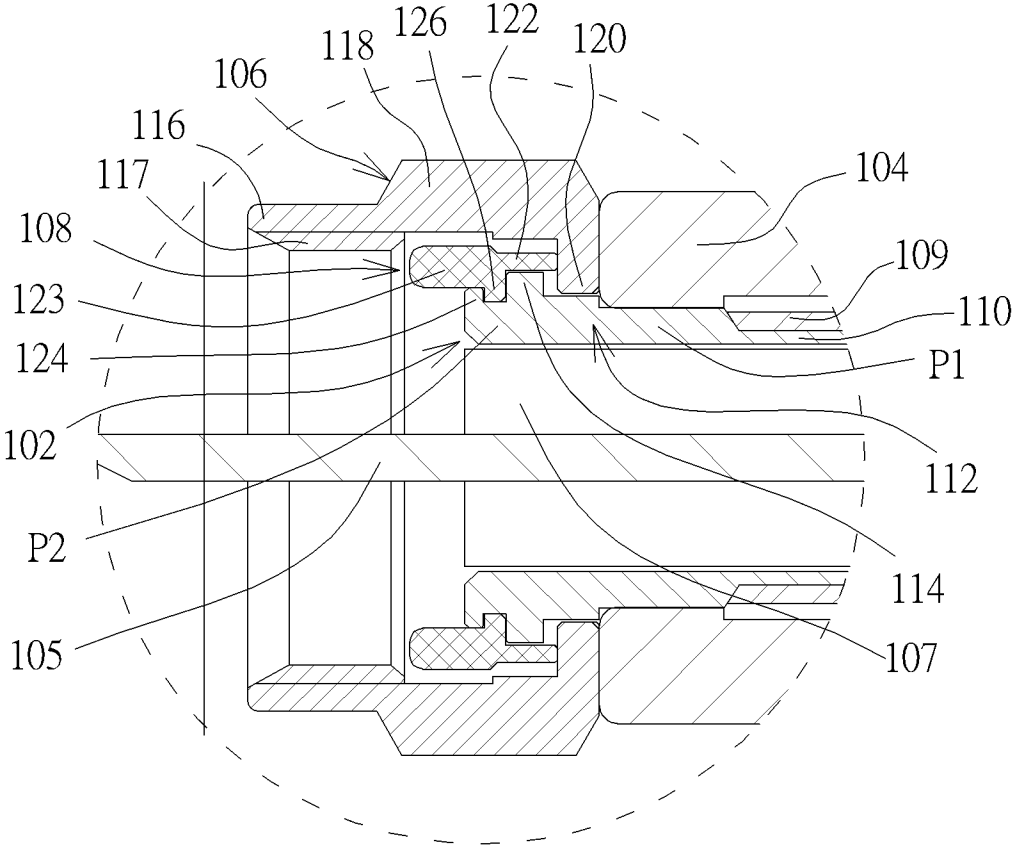
FIG. 2A is an enlarged view of a circled region in FIG. 2.
Figure 3:
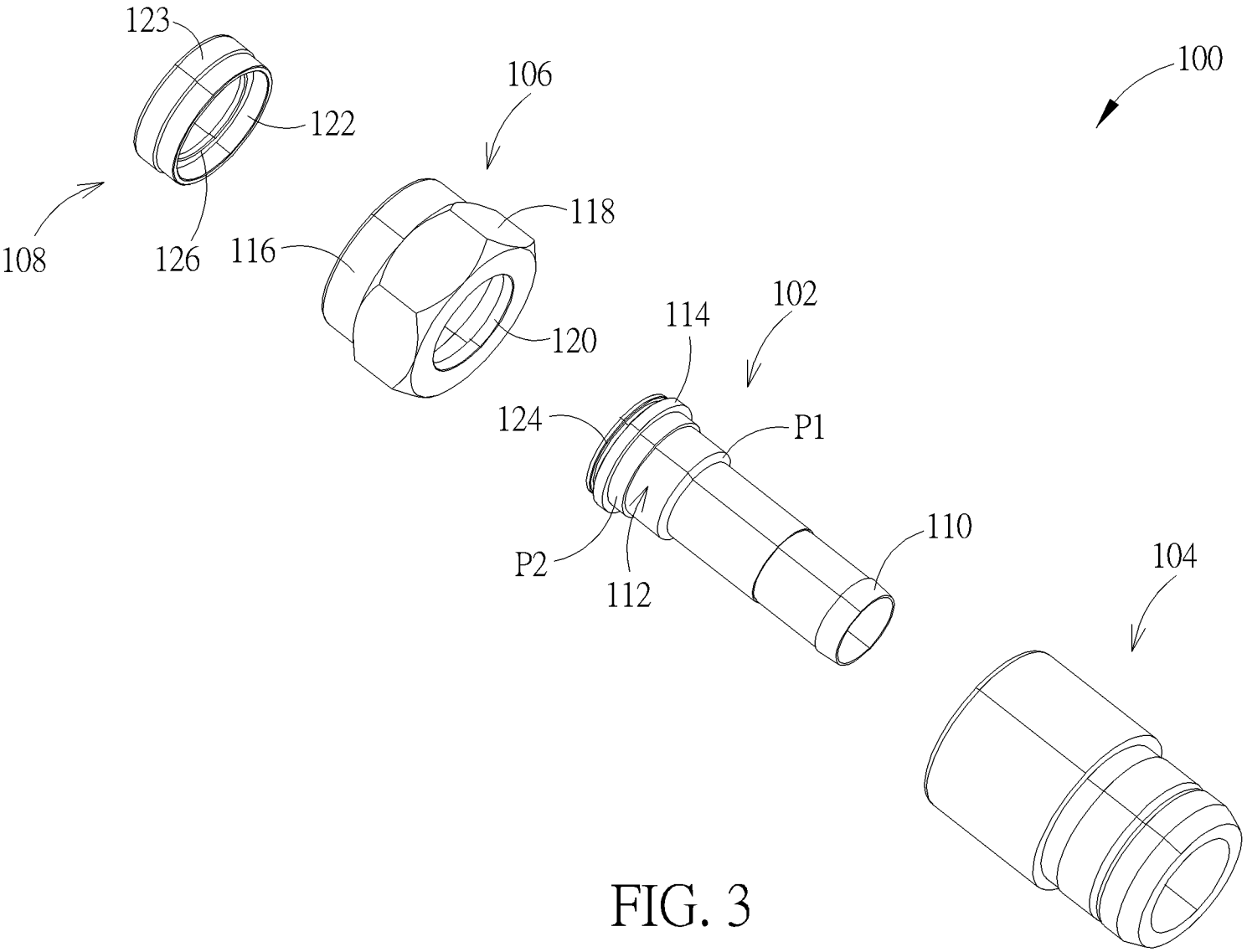
FIG. 3 is an exploded diagram of the coaxial cable connector in FIG. 2.

Please refer to FIG. 2, FIG. 2A and FIG. 3. FIG. 2 is a cross-sectional diagram of a coaxial cable connector 100 being connected to a coaxial cable 101 according to an embodiment of the present invention. FIG. 2A is an enlarged view of a circled region in FIG. 2. FIG. 3 is an exploded diagram of the coaxial cable connector 100 in FIG. 2. As shown in FIG. 2, the coaxial cable connector 100 detachably jackets the coaxial cable 101 and a device connector 103 (could be a common connector of a communication apparatus (e.g. a STB (set-top box) connector or a cable modem connector) to establish signal transmission between the coaxial cable 101 and the device connector 103. The coaxial cable 101 includes a central conductor 105, an insulation layer 107, a metal fence layer 109 and a protection layer 111 (preferably made of plastic material, but not limited thereto). The insulation layer 107, the metal fence layer 109 and the protection layer 111 cover the central conductor 105 sequentially to cooperatively form the coaxial cable 101. As for the related description for the covering layer design of the coaxial cable 101, it is commonly seen in the prior art and omitted herein.

As shown in FIG. 2, FIG. 2A and FIG. 3, the coaxial cable connector 100 includes a metal sleeve 102, a metal clamping sleeve 104, a coupling sleeve 106 and an elastic ring 108 (preferably made of rubber material, but not limited thereto). The metal sleeve 102 has a splitting sleeve 110 and a sleeve body 112 (but not limited thereto, meaning that the present invention could adopt the design that the sleeve body jackets the insulation layer of the coaxial cable and is directly or indirectly coupled to the metal fence layer of the coaxial cable without the splitting sleeve). The metal clamping sleeve 104 jackets a first end portion P1 of the sleeve body 112 and is directly or indirectly coupled to the sleeve body 112 (in this embodiment, the metal clamping sleeve 104 is preferably riveted to the sleeve body 112, but not limited thereto). The splitting sleeve 110 extends axially from the first end portion P1 of the sleeve body 112. Accordingly, when the coaxial cable connector 100 jackets the coaxial cable 101, the splitting sleeve 110 penetrates between the insulation layer 107 and the metal fence layer 109 to make the sleeve body 112 jacket the insulation layer 107 and make the metal fence layer 109 jacket the splitting sleeve 110. In practical application, since the coaxial cable 101 and the coaxial cable connector 100 are still in a loose engagement state, a fixing tool (e.g. a clamp) could be further utilized to radially squeeze the metal clamping sleeve 104 for causing radial deformation of the metal clamping sleeve 104, so that the metal clamping sleeve 104 can clamp the protection layer 111 tightly to fix the coaxial cable connector 100 to the coaxial cable 101 steadily and ensure preferable and stable electrical connection between the metal fence layer 109 and the metal sleeve 102.

The coupling sleeve 106 made of metal material rotatably jackets a second end portion P2 of the sleeve body 112. To be more specific, a first blocking ring structure 114 protrudes radially and outwardly from the second end portion P2 of the sleeve body 112. The coupling sleeve 106 has a connector body 116 and a connection section 118. The connector body 116 could be preferably a hexagonal-shaped nut structure and have an internal thread structure 117 (but not limited thereto). As such, the coaxial cable connector 100 can be detachably coupled to the device connector 103 via the coupling sleeve 106 in a screw-locking manner. A first limiting ring 120 extends radially and inwardly from the connection section 118 to be movably limited between the first blocking ring structure 114 and the metal clamping sleeve 104. In such a manner, via the axial limiting design that the first limiting ring 120 is located between the first blocking ring structure 114 and the metal clamping sleeve 104 (as shown in FIG. 2 and FIG. 2A), the connection section 118 of the coupling sleeve 106 can be rotatably connected to the second end portion P2. To be noted, when the device connector 103 is screwed with the coaxial cable connector 100, the device connector 103 can squeeze the elastic ring 108 to expand elastically, so as to fill a gap between the elastic ring 108 and the coupling sleeve 106. Accordingly, the expanded elastic ring 108 can prevent water vapor from infiltrating into the central conductor 105 of the coaxial cable 101 through the aforesaid gap for efficiently avoiding the short circuit problem.

The elastic ring 108 is disposed in the coupling sleeve 106 and fixedly jackets the second end portion P2 of the sleeve body 112. The elastic ring 108 includes a thick portion 123. The thick portion 123 at least partially (i.e. the whole or a part of the thick portion 123) protrudes from the second end portion P2 of the sleeve body 112 (as shown in FIG. 2 and FIG. 2A), and an abutting structure 122 extends from the elastic ring 108 axially toward the first end portion P1 of the sleeve body 112. An axial cross-sectional area of the abutting structure 122 could be less than an axial cross-sectional area of the thick portion 123. A portion where the elastic ring 108 is assembled with the sleeve body 112 can be taken as a support point, such that the abutting structure 122 can push the first limiting ring 120 of the connection section 118 relative to the support point to laterally bias the coupling sleeve 106 against the metal clamping sleeve 104. As such, an assembly gap between the connection section 118 and the metal clamping sleeve 104 can be eliminated for establishing stable electrical connection between the coupling sleeve 106 and the metal clamping sleeve 104. In summary, since the elastic ring 108 deforms in a non-pressed direction after being pressed by an external force, the elastic ring 108 can deform elastically to fill the gap among the coupling sleeve 106, the metal sleeve 102 and the device connector 103 when the device connector 103 is assembled with the coupling sleeve 106, so as to achieve the waterproof effect.

Via the aforesaid structural designs, the present invention can efficiently solve the prior art problem that signal leakage occurs easily through an assembly gap between the electronic apparatus and the coaxial cable because the coupling sleeve rotatably jackets the internal sleeve of the coaxial cable connector, so as to generate a preferable shielding effect and provide a waterproof function after the coaxial cable connector 100 is connected to the device connector 103. Furthermore, in this embodiment, as shown in FIG. 2 and FIG. 2A, a second blocking ring structure 124 protrudes radially and outwardly from the second end portion P2 of the sleeve body 112, and a second limiting ring 126 extends radially and inwardly from the elastic ring 108 to be clamped between the first blocking ring structure 114 and the second blocking ring structure 124, so as to make the elastic ring 108 fixedly jacket the second end portion P2 of the sleeve body 112.

Figure 4:
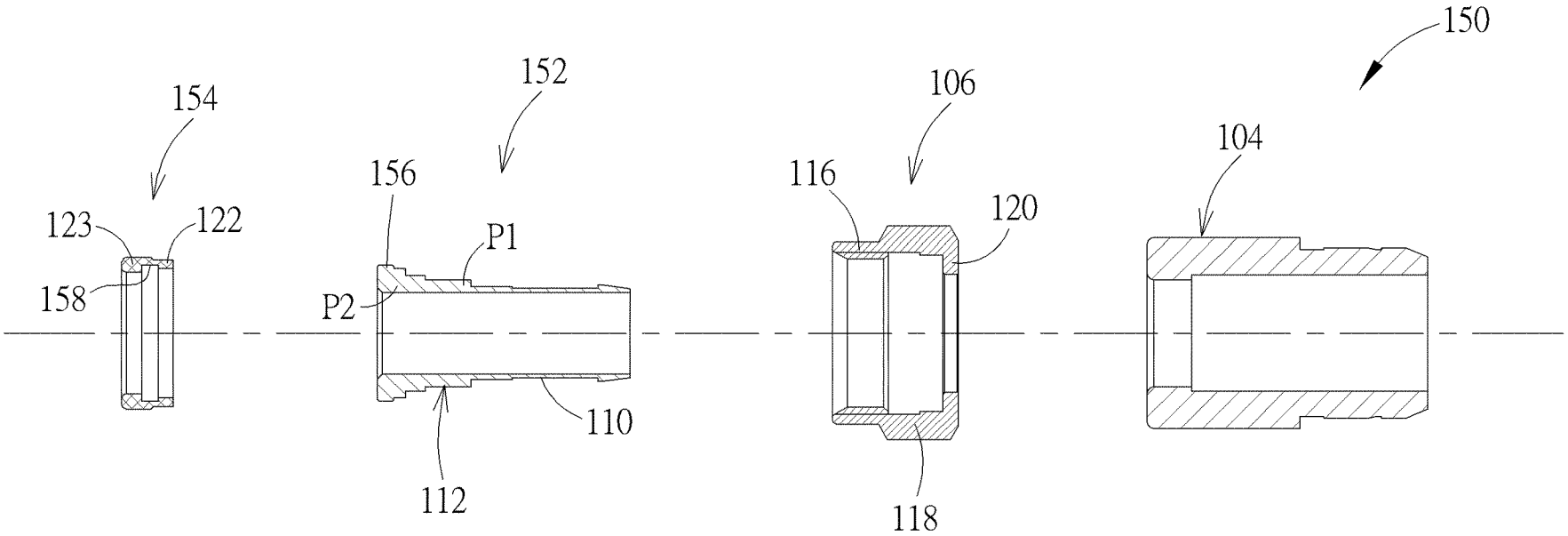
FIG. 4 is a cross-sectional diagram of a coaxial cable connector according to an embodiment of the present invention.
Figure 5:
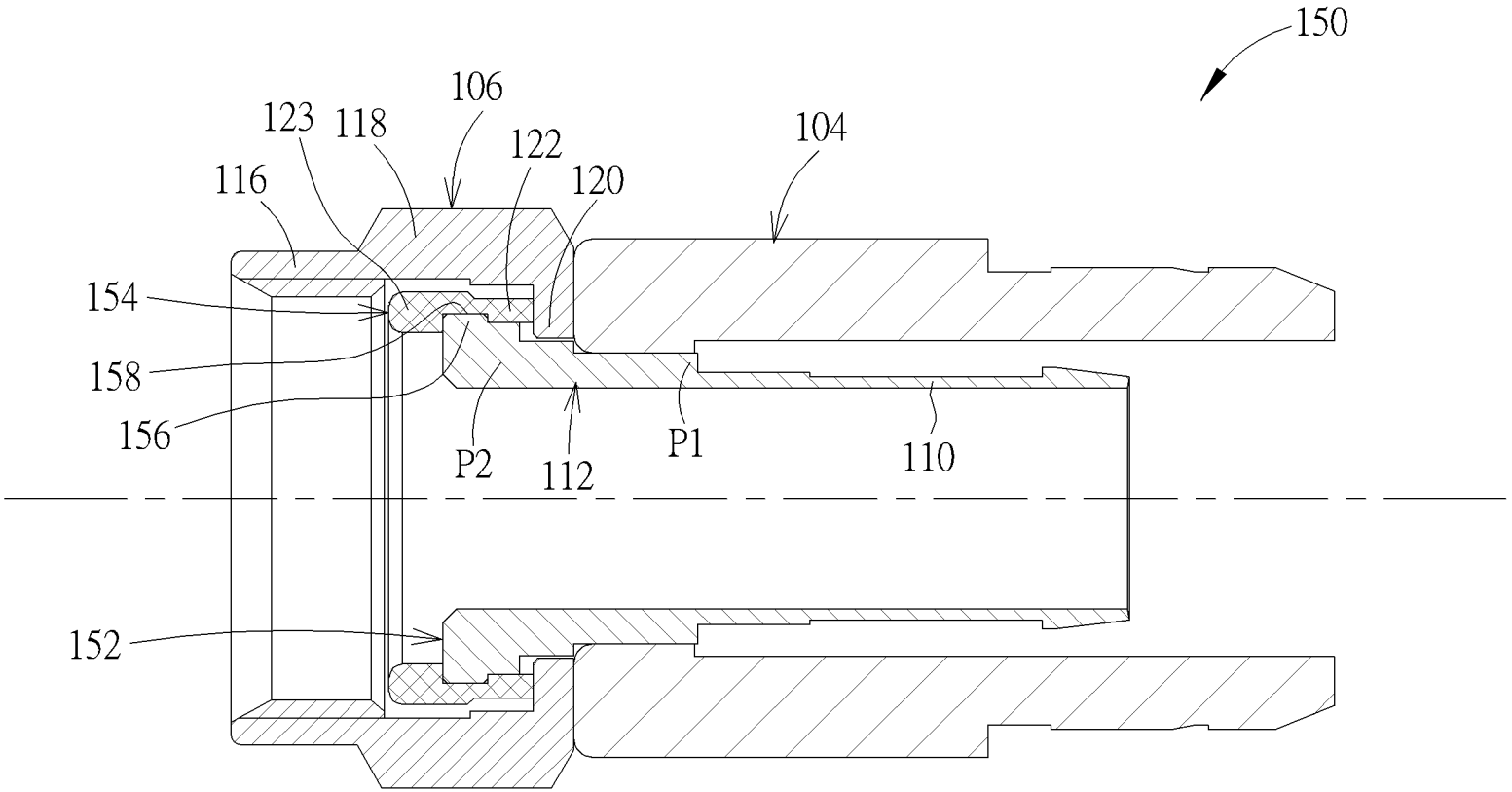
FIG. 5 is a cross-sectional diagram of the coaxial cable connector when being assembled.

It should be mentioned that the design in which the elastic ring fixedly jackets the sleeve body of the metal sleeve is not limited to the aforesaid embodiment. That is, all the structural connection designs in which the elastic ring can be fixed to the sleeve body of the metal sleeve may fall within the scope of the present invention. For example, please refer to FIG. 4 and FIG. 5. FIG. 4 is a cross-sectional diagram of a coaxial cable connector 150 according to an embodiment of the present invention. FIG. 5 is a cross-sectional diagram of the coaxial cable connector 150 when being assembled. Components both mentioned in this embodiment and the aforesaid embodiment represent components with similar functions or structures, and the related description is omitted herein. As shown in FIG. 4 and FIG. 5, the coaxial cable connector 150 includes a metal sleeve 152, the metal clamping sleeve 104, the coupling sleeve 106, and an elastic ring 154 (preferably made of rubber material, but not limited thereto). The metal sleeve 152 has the splitting sleeve 110 and the sleeve body 112. A first blocking ring structure 156 protrudes radially and outwardly from the second end portion P2 of the sleeve body 112, and a limiting slot 158 is recessed from the elastic ring 154 corresponding to the first blocking ring structure 156. Accordingly, the limiting slot 158 can be engaged with the first blocking ring structure 156 to make the elastic ring 154 fixedly jacket the second end portion P2 of the sleeve body 112.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A coaxial cable connector detachably jacketing a coaxial cable and a device connector, the coaxial cable connector comprising:

a metal sleeve having a sleeve body, the sleeve body jacketing an insulation layer of the coaxial cable and being directly or indirectly coupled to a metal fence layer of the coaxial cable when the coaxial cable connector jackets the coaxial cable;

a metal clamping sleeve jacketing a first end portion of the sleeve body, the metal clamping sleeve being directly or indirectly coupled to the sleeve body and tightly clamping the coaxial cable when the metal clamping sleeve is squeezed to deform radially;

a coupling sleeve having a main body and a connection section, the main body being detachably connected to the device connector, the connection section rotatably jacketing a second end portion of the sleeve body; and an elastic ring disposed in the coupling sleeve and fixedly jacketing the second end portion of the sleeve body, the elastic ring having a thick portion and an abutting structure, the thick portion at least partially protruding from the second end portion in an axial direction relative to the sleeve body, the abutting structure extending toward the first end portion axially and pushing the connection section when the elastic ring is not compressed by the device connector, to laterally bias the coupling sleeve against the metal clamping sleeve for establishing electrical connection between the coupling sleeve and the metal clamping sleeve.

2. The coaxial cable connector of claim 1, wherein a first blocking ring structure protrudes radially and outwardly from the second end portion of the sleeve body, and a first limiting ring extends radially and inwardly from the connection section to be movably limited between the first blocking ring structure and the metal clamping sleeve, so as to make the connection section rotatably jacket the second end portion.

3. The coaxial cable connector of claim 2, wherein a second blocking ring structure protrudes radially and outwardly from the second end portion of the sleeve body, and a second limiting ring protrudes radially and inwardly from the elastic ring to be clamped between the first blocking ring structure and the second blocking ring structure, so as to make the elastic ring fixedly jacket the second end portion of the sleeve body.

4. The coaxial cable connector of claim 3, wherein the metal sleeve further has a splitting sleeve, the splitting sleeve extends axially from the first end portion of the sleeve body, and the splitting sleeve penetrates between the insulation layer and the metal fence layer of the coaxial cable when the coaxial cable connector jackets the coaxial cable.

5. The coaxial cable connector of claim 2, wherein a limiting slot is recessed from the elastic ring corresponding to the first blocking ring structure, and the limiting slot is engaged with the first blocking ring structure to make the elastic ring fixedly jacket the second end portion of the sleeve body.

6. The coaxial cable connector of claim 5, wherein the metal sleeve further has a splitting sleeve, the splitting sleeve extends axially from the first end portion of the sleeve body, and the splitting sleeve penetrates between the insulation layer and the metal fence layer of the coaxial cable when the coaxial cable connector jackets the coaxial cable.

* * * * *